US005649403A

United States Patent [19]

Haisch

[11] Patent Number: 5,649,403

[45] Date of Patent: Jul. 22, 1997

[54] TRUSS STRUCTURE

[76] Inventor: Douglas C. Haisch, 1800 S. Barney St., Anderson, Calif. 96007

[21] Appl. No.: 368,478

[22] Filed: Jan. 4, 1995

[51] Int. Cl.[6] ..... E04C 3/04

[52] U.S. Cl. ..... 52/693; 52/692; 52/695; 52/639

[58] Field of Search ..... 52/639, 692, 693, 52/642, 695

[56] References Cited

U.S. PATENT DOCUMENTS

| | | | |
|---|---|---|---|
| 2,902,951 | 9/1959 | Maag | 52/692 |
| 4,414,787 | 11/1983 | Kappen | 52/693 X |
| 4,435,940 | 3/1984 | Davenport et al. | 52/639 X |
| 5,417,028 | 5/1995 | Meyer | 52/693 X |
| 5,560,177 | 10/1996 | Brightwel | 52/693 X |

FOREIGN PATENT DOCUMENTS

| | | | |
|---|---|---|---|
| 1100070 | 3/1955 | France | 52/693 |

*Primary Examiner*—Wynn E. Wood
*Assistant Examiner*—W. Glenn Edwards
*Attorney, Agent, or Firm*—Bielen, Peterson & Lampe

[57] ABSTRACT

A truss structure utilizing three open channeled rigid members or chords which are preferably made of metallic material. A web constructed of at least two spanning members that are angularly attached to one another, are connected to the first, second, and third channel members. First and second open channel members are each connected to one another at one end and to the third rigid open channel member at the other end to form a triangular structure with the web portion in between. Structural elements are connected to the web and are capable of lying within the open channel members to permit interlinkage between the web and the chords to complete the truss structure.

8 Claims, 2 Drawing Sheets

TRUSS STRUCTURE

BACKGROUND OF THE INVENTION

The present invention relates to a novel truss structure for use in constructing buildings.

Trusses are often employed in edifices to provide rigidity and support to the frame of the same. In the past, trusses have been constructed of wooden members or planks arranged in a triangular or triangular-like configuration. In essence, trusses include chords forming the exterior of the same and with a web or series of posts or spanning members between the chord portions.

In the past, wood and metallic materials have been used together to construct buildings. U.S. Pat. No. 2,286,158 describes a building unit which employs steel studs in conjunction with wooded cross nailers or girts at spaced intervals between the studs.

U.S. Pat. No. 2,471,675 shows utilization of steel tubing or piping which have been employed as vertical studs and rafters.

Various other prior art references depict use of metallic materials to reinforce or brace wooden structural members for increasing strength or provide fire resistant capabilities. For instance, U.S. Pat. No. 3,175,253 describes metallic bridging members to support subfloor joists.

U.S. Pat. No. 4,411,547 teaches the bracing of structural members by the use of channel sections and clamping strips between multiple wooden planks.

U.S. Pat. No. 4,106,258 describes composite wooden steel joists assemblies in which steel channel members are utilized to face wooden members outwardly to accept wooden fasteners such as nails or staples.

Several systems have been proposed to provide metallic braces for wood structures such as girders and trusses. U.S. Pat. No. 3,531,904 describes the use of flat metal strips placed longitudinally to wooden components.

U.S. Pat. No. 4,669,243 shows a metallic web structure using a U-shaped channel to aid in the support of wooden chord members in a truss structure.

U.S. Pat. No. 3,286,429 teaches a composite wood metal structural member having a Z-shaped reinforcing brace.

U.S. Pat. Nos. 4,211,044 and 4,274,241 show wooden truss structures employing plating and bracing formed of metallic channels.

Deteriorating raw wood quality has necessitated to institution of strict quality control measures in the manufacturing of truss structures. Even under such stringent quality control measures, many wooden truss structures which are manufactured are recalled for repairs and replacement of members due to shrinkage and warpage.

A truss structure which eliminates the disadvantages of wooden structural members would be a notable advance in the building industry.

SUMMARY OF THE INVENTION

In accordance with the present invention, a novel and useful truss structure is herein provided.

The truss structure of the present invention employs first and second rigid open channel members which are angularly connected to one another and form the top chord portion of the truss. A third rigid open channel member is constructed to serve as the bottom chord of the truss structure. The first, second, and third rigid, open, channel members may be formed of metallic material or a composite material and the like which is essentially rigid and not subject to warpage or twisting through a seasoning process. A web in the form of a plurality of spanning members interposes the connected top first and second rigid open channel members and the lower third rigid open channel member. The web is generally configured in a zig-zag pattern to form a plurality of triangular members within the truss structure.

First connecting means links the first and second rigid open channel members together in an angular configuration to form the crown or top chords of the truss structure. First connecting means also links the connected first and second rigid open channel members to the web. Second connecting means is provided in the present invention for linking the web to the third rigid open channel member through a plurality of spanning members positioned between the first and second rigid open channel members. Third connecting means connects the first rigid open channel member to the third rigid open channel member, while fourth connecting means links the second rigid open channel member to the third rigid open channel member. The latter connection takes place at the ends of the connected first and second rigid open channel members distally from the place of connection at the crown of the truss.

A structural element is also used in the present invention. The structural element may be in the form of a wooden member, which is capable of at least partially being positioned within any of the first, second, and third open channel members. Needless to say, a plurality of structural elements may be employed therewith. The structural elements are also suitable for being fixed in such a position by fasteners which extend through the rigid open channel members to engage a particular structural element. In addition, each structural element which may be wooden, is connected or tied to the web structure. Thus, each structural element serves as a filler which is capable of receiving fasteners through the open channel members and is easily attached to the intermediate web portion of the truss structure. Any warpage of wooden structure element will not affect the rigidity of the truss structure.

Structural elements may thus be found in the first and second connecting means. In addition, structural elements may also be included in the third and fourth connecting means for linking the distal ends of the connected first and second rigid open channel members and the third rigid open channel members. Moreover, the structural elements at the third and fourth connecting means may extend outwardly from the truss structure and serve as a connection between the truss and a post or vertical column in the edifice in which the truss structure is used.

Fastening means may also be employed to hold any structural element associated with any of the first, second, and third rigid open channel members relative to the web. Such fastening means may take the form of a pair of plates fixed to the web and the particular structural element. A plurality of fasteners would engage the pair of plates from the structural element. In addition, a plurality of fasteners would selectively engage the first, second, and third open channel members and a particular structural element lying within any of such open channel members.

It may be apparent that a novel and useful truss structure has been described.

It is therefore an object of the present invention to provide a truss structure which utilizes rigid open channel members, not subject to warpage, in substitution for wooden planks normally used in a truss structure to provide a truss structure which is not susceptible to warpage.

Another object of the present invention is to provide a truss structure which utilizes metallic rigid open channel members instead of wooden structural members to provide a truss structure which is normally straight and not subject to stringent quality control measures, which is the case with a prior art wooden truss structure.

Another object of the present invention is to provide a truss structure which is not likely to require labor costs to correct defective portions thereof.

Another object of the present invention is to provide a truss structure which eliminates wooden members normally found in a truss structure and possesses a weight which is comparable to the prior art wooden truss structures.

Yet another object of the present invention is to provide a truss structure which does not employ wooden structural members, that are easy to form, and that are comparable in cost to the prior art wooden truss structure.

The invention possess other objects and advantages especially as concerns particular characteristics and features thereof which will become apparent as the specification continues.

For a better understanding of the invention, references made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments which should be taken in conjunction with the heretobefore described drawings.

Figure 1:
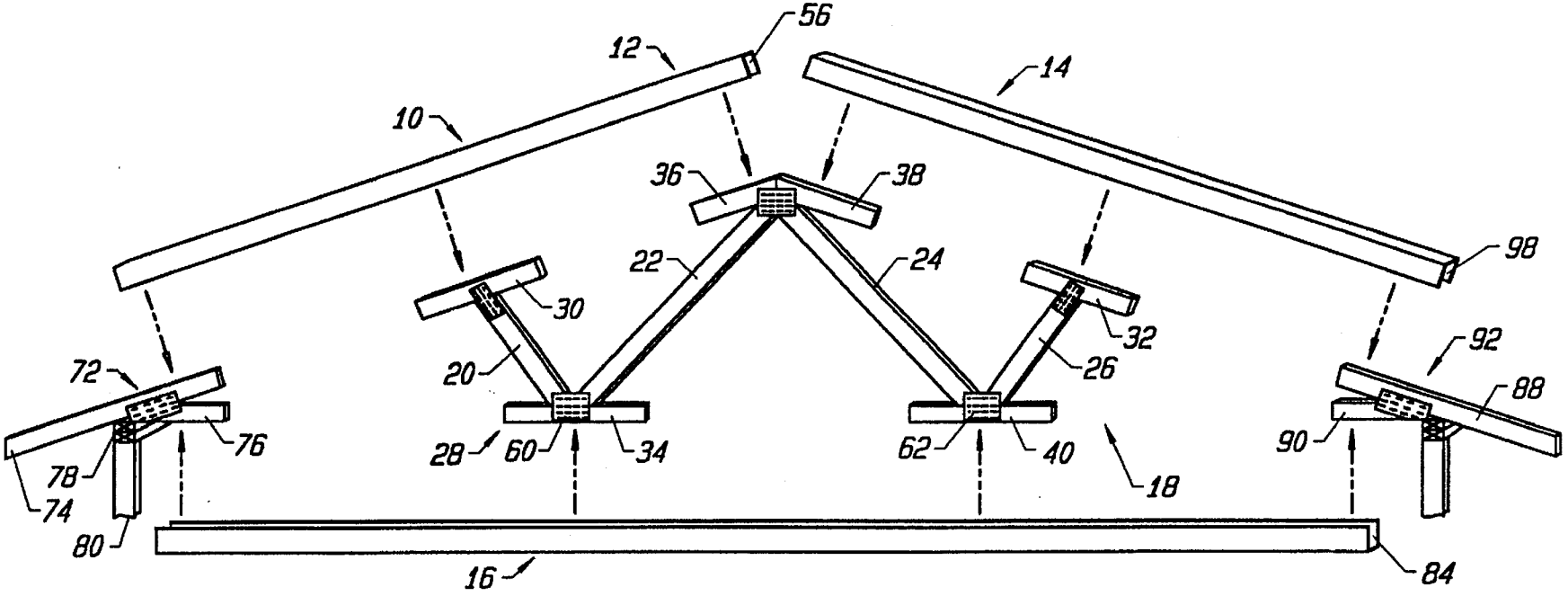
FIG. 1 is an exploded view of the truss structure of the present invention revealing the assemblage and parts thereof.

FIG. 1 shows the truss structure 10 in separated or exploded configuration. Truss structure 10 includes first rigid open channel member 12, second rigid open channel member 14, and third rigid open channel member 16. Channel members or chords 12, 14, and 16 may be constructed of metallic U-shaped steel, or any other material which is rigid and not subject to warpage or shrinkage. Channel members 12, 14, and 16 may be of any size commensurate with strength considerations and requirements for supporting edifices. Web 18 is also depicted in FIG. 1 and includes spanning members 20, 22, 24, and 26 which may be formed of wooden planks or members such as 2×4's, 2×6's, 2×12's, and the like. Web 18 is formed in a zig-zag pattern and includes a plurality of wooden structural members or elements which are sized to fit within the channels provided by rigid open channel members 12, 14, and 16. Structural elements 30 and 32 are found at the termini web 18. On the other hand, structural members or elements 34, 36, 38, and 40 are fastened to the intermediate portions of web 18, where spanning members 20, 22, 24, and 26 are connected to one another in angular configuration.

Figure 4:
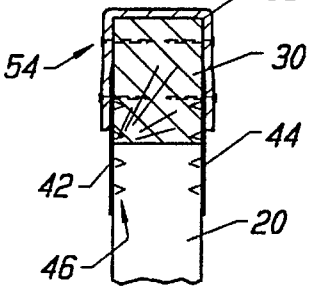
FIG. 4 is a sectional view taken along line 4—4 of FIG. 2.

With reference to FIG. 4, it may be observed that exemplar spanning member 20 is fixed to structural element 30 by the use of a pair of plates 42 and 44 having a multiplicity of teeth or prongs 46. Plates 42 and 44 are pressed into context with spanning member 20 and structural element 30 to hold spanning member 20 and structural element 30 together. Structural element 32 is held to spanning member 26 in the same manner.

Figure 2:
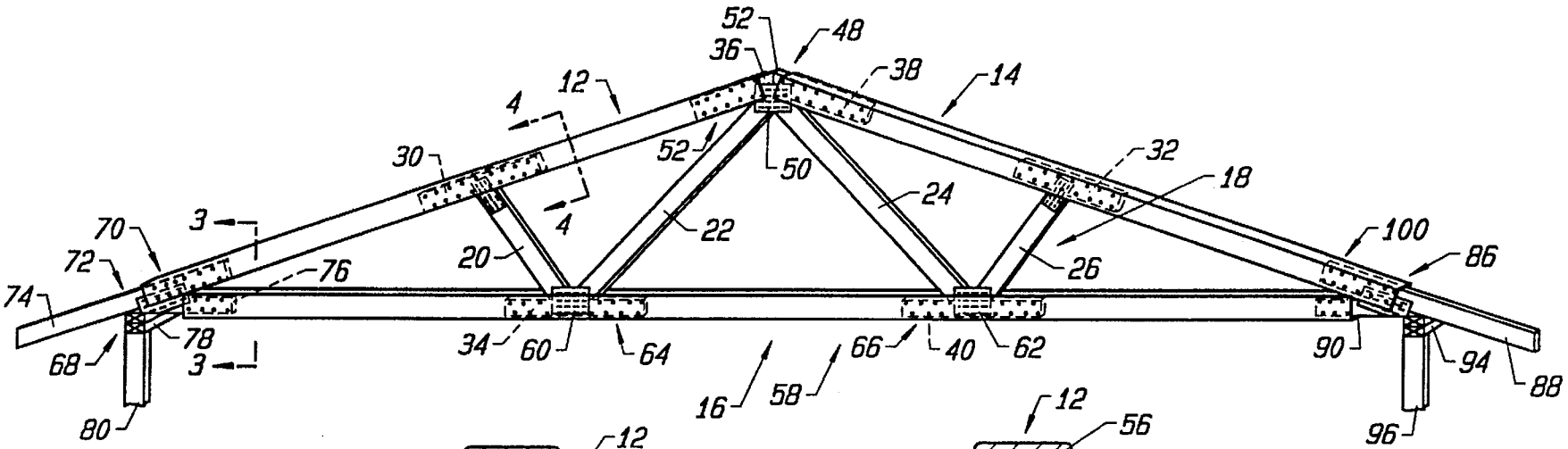
FIG. 2 is a top right perspective view of the truss structure of the present invention in its assembled condition.

Turning to FIG. 2, it may be seen that first connecting means 48 is depicted. First connecting means 48 includes a pair of plates 50 (one plate not shown) which interconnect spanning members 22 and 24 with structural elements 36 and 38. In addition, first connecting means 48 serves to tie together first rigid open channel members 12 and 14. Such linking is achieved by placement of structural elements 36 and 38 within the channels or openings 56 and 98, formed by chords 12 and 14, respectively, FIG. 1. A plurality of fasteners 52, such as screws are also employed to tie these elements together. With reference to FIG. 4, multiplicity of screw fasteners 54 of similar structure to fasteners 52 are employed therein to hold structural element 30 to first rigid open channel member 12. Channel 56 of first rigid open Channel member 12 also incorporates plates 42 and 44.

Second connecting means 58 links web 18 to third chord 16 FIGS. 1 and 2. In this regard, pairs of plates 60 and similar to pair of plates 50 are fastened to spanning members 20, 22, 24, and 26. It should be noted that FIGS. 1 and 2 reveal only one plate of each pair of plates 60 and 62, the other of said pair of plates 60 and 62 being fastened to the other side of spanning members 20, 22, 24, and 26 as depicted on FIG. 2 (not shown). Fasteners similar to plurality of fasteners 52 and 54 are employed in the fastening of pairs of plates 60 and 62 to spanning members 20, 22, 24, and 26, and to structural elements 34 and 40 depicted in phantom on FIG. 2. Again, second connecting means 58 is further provided with plurality of fasteners 64 and 66, which may be threaded members, to hold structural elements 34 and 40 to chord 16.

Figure 3:
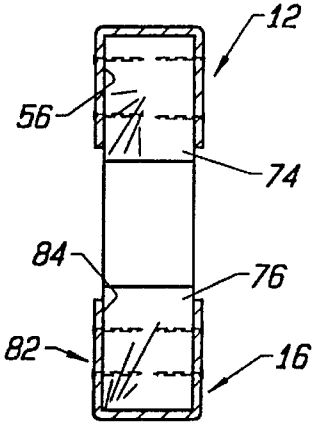
FIG. 3 is a sectional view taken along line 3—3 of FIG. 2.

Third connecting means 68 links chord 12 to chord 16 at chord 12 and portion 70 which is distal from first connecting means 48. Pair of plates 72 (one shown on FIG. 2) sandwich timber planks 74 and 76 together in a roughly Y-shaped configuration. Of course, fasteners are employed to fasten pair of plates 72 to plank 74 and 76 as is the case with pairs of plates 60 and 62. Plank 72 and 76 rest on header 78 and posts 80 which may be part of an edifice. Plurality of fasteners 82, which may be threaded members, hold planks 74 and 76 to chords 12 and 16, FIG. 3. As may be observed, planks 74 and 76 fit at least partially into channels 56 and 84 of chords 12 and 16, respectively.

Fourth connecting means 86, FIG. 2, is similar to connecting means 68, being the mirror image thereof. In this regard, planks 88 and 90 are sandwiched by a pair of plates 92, one of which is depicted on FIG. 2. Header 94 and post 96 support planks 88 and 90. Channel 98 of chord 14 and channel 84 of chord 16 fit over and at least partially encompass planks 88 and 90. Plurality of fasteners 100, which may be threaded members, hold chords 14 and 16 to planks 88 and 90. Thus, fourth connecting means completes the overall triangular configuration of truss structure 10. It should be realized that truss structure 10 may take other configurations such as trapezoids, rectangles, and the like.

In the assemblage and operation of truss structure 10, web 18 is linked or connected to chords 12, 14, and 16 by first, second, third, and fourth connecting means 48, 58, 68, and 86. Structural elements 30, 32, 34, 36, 38, and 40 affixed to web 18 are sized to at least partially lie within channels 56, 98, and 84, of chords 12, 14, and 16, respectively. Plurality of fasteners such as fasteners 52 are used to hold such structural elements to chords as described herein. Truss structure 10 is not subject to warpage or shrinkage normally associated with lumber since the load bearing chords 12, 14, and 16 are composed of metallic or similar materials that exhibit rigidity. Warpage or shrinkage of structural elements 30, 32, 34, 36, 38, and 40, as well as web 18 do not affect the structural rigidity of chords 12, 14, and 16.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A truss structure comprising:

a. a first rigid open channel member;

b. a second rigid open channel member;

c. a third rigid open channel member; said first, second, and third rigid open channel members formed of a material not subject to warpage, said open channels of said first and second rigid open channel members being positioned to face the open channel of said third rigid open channel member;

d. a web;

e. first connecting means for linking said first rigid open channel member to said second rigid open channel member and to said web;

f. second connecting means for linking said web to said third rigid open channel member; said web including at least one spanning member positioned between said connected first and second rigid open channel members;

g. third connecting means for linking said first rigid open channel member to said third rigid open channel member; and h. fourth connecting means for linking said second rigid open channel member to said third rigid open channel member;

said first and second connecting means each including a structural element being positioned at least partially within and along said first and third rigid open channel members, respectively, said structural elements, positioned at least partially within each of said first and third rigid open channel members, being directly connected to said web, and fastening means for selectively holding said structural elements at least partially within said first and third rigid open channel members.

2. The truss structure of claim 1 in which said web includes at least two spanning members positioned between said first and second connecting means and said second connecting means includes first and second structural elements each connected to one of said spanning members of said web and being capable of being positioned within said third rigid open channel member, and said fastening means for holding said web first and second structural elements at least partially within said third rigid open channel member.

3. The truss structure of claim 1 in which said fastening means includes a pair of plates fixed to said web and to at least one of said structural elements, and a plurality of fasteners engaging said plates, said structural elements and, selectively, said first and second rigid open channel members.

4. The truss structural of claim 3 in which said plurality of fasteners are threaded members.

5. A truss structure utilizing:

a. a web including at least two spanning members angularly affixed to one another, said web including a first end portion, a second end portion, and an intermediate portion;

b. a first structural element connected to said web first end portion;

c. a second structural element connected to said web intermediate portion;

third structural element connected to said web second end portion;

e. a first rigid open channel member;

f. a second rigid open channel member;

g. a third rigid open channel member, said open channels of said first and second rigid open channel members being positioned to face the open channel of said third rigid open channel member said first, second, and third rigid open channel members being formed of a material not subject to warpage; and h. connecting means for linking said first, second, and third structural elements connected to said web to said first, second, and third rigid open channel members such that each of said first, second, and third structural elements lies at least partially within and along one of said first, second, and third rigid open channel members.

6. The truss structure of claim 5 in which said structural elements are wooden.

7. The truss structure of claim 5 in which said connecting means includes a plurality of fasteners engaging said first, second, and third structural members and said first, second, and third rigid open channel members.

8. The truss structure of claim 5 in which said connecting means further includes connecting means for linking said first rigid open channel member to said third rigid open channel member, and connecting means to link said second rigid open channel member to said third rigid open channel member.

* * * * *